US005165204A

United States Patent [19]

Luedeke et al.

[11] Patent Number: 5,165,204

[45] Date of Patent: Nov. 24, 1992

[54] TOOL HOLDER ASSEMBLY

[75] Inventors: Arthur P. Luedeke, Marine; Bradley W. Keller, Lino Lakes, both of Minn.

[73] Assignee: Minnesota Mining and Manufacturing Company, St. Paul, Minn.

[21] Appl. No.: 638,047

[22] Filed: Jan. 7, 1991

Related U.S. Application Data

[63] Continuation-in-part of Ser. No. 359,729, May 31, 1990.

[51] Int. Cl.[5] ..... B24B 41/06

[52] U.S. Cl. ..... 51/145 T; 51/216 R; 51/217 R; 51/237 T; 269/58; 269/74

[58] Field of Search ..... 51/216 R, 217 R, 218 R, 51/237 T, 145; 269/58, 59, 74, 317

[56] References Cited

U.S. PATENT DOCUMENTS

| | | | |
|---|---|---|---|
| 1,537,697 | 5/1925 | Roberts . | |
| 1,817,554 | 8/1931 | Griswold . | |
| 2,110,931 | 3/1938 | Dyer et al. | 51/103 |
| 2,406,728 | 8/1946 | Wharton . | |
| 2,484,583 | 10/1949 | Paulson | 51/134 |
| 2,546,504 | 3/1951 | Head | 51/217 |
| 2,554,079 | 5/1951 | Wilson | 51/76 |
| 2,695,479 | 11/1954 | Indge | 51/131 |
| 2,814,919 | 12/1957 | Jones et al. | 51/215 |
| 2,990,659 | 7/1961 | Benkovich et al. | 51/118 |
| 3,322,434 | 5/1967 | McClung | 279/123 |
| 3,526,062 | 9/1970 | Sommer | 51/108 |
| 3,864,816 | 2/1975 | Brusch | 29/563 |
| 4,272,088 | 6/1981 | Perry | 279/114 |
| 4,399,988 | 8/1983 | Deshong | 269/58 X |
| 4,833,831 | 5/1989 | Armstrong, Jr. | 51/217 R X |

FOREIGN PATENT DOCUMENTS 1945499 6/1966 Fed. Rep. of Germany .

*Primary Examiner*—M. Rachuba

*Attorney, Agent, or Firm*—Gary L. Griswold; Walter N. Kirn; Jeffrey J. Hohenshell

[57] ABSTRACT

A tool holder assembly for use with a workpiece feed mechanism and machining mechanism for forming a new surface on a workpiece is described. The workpiece feed mechanism has slot surfaces extending defining an opening which includes bearing surfaces. The tool holder assembly comprises a removable support including a plate adapted to be received in the slot. The plate has surfaces defining a socket and has shoulder surfaces adapted to engage the bearing surfaces. The tool holder assembly includes a tool receptacle which is adapted to receive the workpiece. At least one detent is provided which includes detent surfaces adapted to engage the socket in the plate. The detents are mounted on the workpiece feed mechanism for movement between a locking position where the detent surfaces of the detent are engaged with the socket, and a release position where the detent surfaces of the detent are spaced from the socket to afford sliding movement of the support within the slot. A spring is present that biases the detent toward the locking position and biases the shoulder of the plate outward toward engagement with the bearing surfaces to thereby hold the support on the workpiece feed mechanism while the new surface is formed on the workpiece by the machining mechanism. Also present is an actuation mechanism for moving the detent mechanism from the locking position to the release position and for overcoming the secure engagement between the shoulder surfaces of the plate and the bearing surfaces of the slot before the support is slid within the slot.

15 Claims, 8 Drawing Sheets

TOOL HOLDER ASSEMBLY

This is a continuation-in-part of application Ser. No. 07/359,729 filed May 31, 1990, for which a Notice of Allowance was mailed on Nov. 16, 1990 the entire specification, including the drawings, of which is herein expressly incorporated by reference.

TECHNICAL FIELD

The present invention relates to tool holder assemblies adapted for use with workpiece feed and machining mechanisms for forming or producing a new surface on an object or workpiece, such as a wrench.

BACKGROUND ART

Tool holder assemblies are known that are adapted for use with workpiece feed and machining means or mechanisms for creating a new surface on an object or workpiece, such as a wrench. Such tool holders are used, for example, with workpiece feed and machining mechanisms to change an original rough or irregular edge surface resulting from the method of forming the wrench (e.g. drop forging) into a new, smoothly arced edge surface that is more aesthetically pleasing and easier on the hand of a user of the wrench than the original rough or irregular surface.

One such machining mechanism comprises a belt grinding assembly including a drive mechanism for driving an abrasive belt in a first direction along a path past a backup platen fixed to frame means for the machining mechanism, which platen has a support surface for the abrasive belt adjacent its rear surface that is straight in the direction of travel of the belt and has a uniform shape corresponding to the shape of the edge surface to be radiused in a direction at a right angle to the direction of travel of the belt One such workpiece feed mechanism comprises workpiece or object manipulating means including a wheel for moving the edge surface of the workpiece along an arcuate path about an axis at a right angle to the direction of travel of the belt into forceful engagement with the abrasive coated surface of the belt along the support surface to form the radius on the edge of the workpiece.

FIGS. 1A and 1B illustrate elements of a known tool holder assembly, generally designated by the reference number 1. The workpiece feed means comprises a wheel 2 having slot surfaces 3 defining an opening on the peripheral portion of the wheel 2. The slot surfaces 3 include surfaces defining a dovetail slot which includes bearing surfaces 4 and a bottom surface 5. The known tool holder assembly 1 includes a removable plate (not shown) having shoulder surfaces and a tool receptacle (not shown) projecting radially from the plate. The plate is shaped to be slid into the dovetail slot 3 with the tool receptacle projecting radially therefrom.

The known tool holder assembly 1 also includes four pressure buttons 7 mounted within four generally, cylindrical holes or counterbores 6 which open into the bottom surface 5 of the dovetail slot in the workpiece feed means and four corresponding coil springs 8 mounted between the bottom of the cylindrical hole and a flange on the pressure button 7. The coil springs 8 constantly bias an arcuate top portion 9 of the pressure buttons 7 to project above the bottom surface 5 of the dovetail slot 3. The generally cylindrical holes 6 include lip surfaces 13 opposite the bottom of the hole and adjacent the bottom surface 5 of the dovetail slot 3. The lip surfaces 13 engage the flange on the pressure buttons 7 and restrict the amount of projection of the pressure buttons 7 into the slot 3.

The removable plate includes a bottom surface (not shown) adapted to be engaged with the top portion 9 of the pressure button 7. When the removable plate of the known tool holder is axially slid into the slot 3, the bias of the coil springs 8 biases the arcuate top portion 9 of the pressure button 9 against the bottom surface of the plate and also biases shoulder surfaces (not shown) of the plate toward the bearing surfaces 4 of the dovetail slot 3 and thereby provides a secure frictional engagement between the shoulder surfaces of the plate and the bearing surfaces 4 of the slot 3. The secure frictional engagement between the shoulder surfaces of the plate and the bearing surfaces 4 of the slot 3 is sufficient to hold the tool receptacle means steady as the wheel 2 moves the edge surface of the workpiece along an arcuate path into forceful engagement with the abrasive coated surface of the belt to form the radius on the workpiece Engagement between a side of the plate and a stop surface 47 mounted on the wheel 2 positions the plate at a predetermined location relative to the periphery of the wheel 2.

The known tool holder assembly initially encounters problems when the user slides the plate and attached tool receptacle into the dovetail slot 3. In order to provide sufficient frictional engagement between the bearing surfaces 4 of the slot 3 and the shoulder surfaces of the plate, the coil springs 8 are required to have a relatively high spring constant (i.e. 40 pounds per inch) which may be controlled by a set screw 41. When the user slides the plate and attached tool holder into the slot 3, the user ultimately must overcome the bias of each of the coil springs 8. The bias of the first few coil springs 8 may be overcome relatively easily by manually sliding the plate into the slot 3. However, while the arcuate top portion 9 of the pressure buttons 7 are shaped to afford passage of the plate into the dovetail slot 3, the four coil springs 8 constantly bias the pressure buttons 7 into the bottom of the dovetail slot 3 and against the plate which makes sliding the plate into the slot progressively more difficult as the plate encounters each pressure button 7. The coil springs 8 also bias the shoulder surfaces of the plate into frictional engagement with the bearing surfaces 4 of the dovetail slot 3. Such frictional engagement is difficult to overcome when the plate is slid into the dovetail slot 3, particularly when the user is attempting to slide the plate over the last few pressure buttons 7. This problem is exacerbated by grinding swarf and dirt such as abrasive and metal particles which contaminate the clearances between the pressure buttons 7 and bores 6.

One solution to this problem has been for a user to use an air hammer or like device to fully slide the plate into the dovetail slot 3. This solution, however, causes excessive wear on wear surfaces (i.e. between the arcuate top portion 9 and the bottom of the plate and between the shoulder surfaces of the plate and the bearing surfaces 4 of the slot 3) which further results in undesirable consequences such as wear grooves eroded into the bottom of the plate, loss of frictional engagement between the bearing surfaces and shoulder surfaces of the plate, loss of bias from the coil springs 8, loosening of the tooling, and premature deterioration of the slot surfaces 3. It is believed that the grinding swarf becomes caught between the wear surfaces of the tool holder assembly 1 and "binds the assembly" or acts as an abrasive to accelerate the deterioration of the wear surfaces of the assembly 1.

The known tool holder assembly also encounters problems when the user exchanges the plate and attached tool receptacle with a different plate and attached tool receptacle. For example, the user may desire to exchange the existing tool receptacle (i.e. a tool receptacle for a wrench) with a different tool receptacle (i.e. a tool receptacle for a wrench having a different shape or for a different workpiece altogether such as, for example, a hammer). The coil springs 8 of the known tool holder assembly 1 constantly bias the shoulder surfaces of the plate toward the bearing surfaces 4 of the dovetail slot 3 and thus, constantly provide a secure frictional engagement between the slot 3 and the plate which must be overcome for a plate and tool receptacle to be replaced with a different plate and tool receptacle Again, grinding swarf further exacerbates the problem as it tends to become trapped between wear surfaces such as between the pressure buttons 7 and the bores 6 and between the springs 8 and the pressure buttons. 7 Such an intrusion by the grinding swarf into the clearances of the tool holder assembly 1 results in many undesirable consequences such as preventing the user from sliding the plate completely into the slot 3, premature deterioration of wear surfaces, and jamming of the pressure buttons 7. One solution to this problem entails first blowing the swarf from the slot 3 and then using an air hammer or like device to forcefully slide the plate out of the slot. This solution, however, takes additional time and creates a great deal of wear which, after multiple uses, creates undesirable erosion of the wear surfaces on the plate and slot 3.

DISCLOSURE OF INVENTION

The present invention provides an easily changeable tool holder assembly for use with a workpiece feed means such as a wheel, and machining means such as an endless coated abrasive belt assembly, that can form a new surface on an object or workpiece. The tool holder assembly of the present invention provides a tool receptacle which may be quickly and efficiently manually inserted into a slot on the workpiece feed means. The tool holder assembly of the present invention also provides an assembly which saves substantial time (i.e. as much as seventy-five percent compared with the prior art) during tool changeover, which exhibits reduced wear in the parts of the tool holder assembly, which is easily machined and which may be easily, quickly and efficiently manually exchanged with a different tool holder assembly that may include a different tool receptacle.

The tool holder assembly according to the present invention comprises the workpiece feed means having slot surfaces defining an opening extending axially through a peripheral portion of the workpiece feed means. Those slot surfaces include bearing surfaces diverging on opposite sides of the opening. The tool holder assembly also comprises a removable support including a plate adapted to be received in the slot. The plate has surfaces defining a socket opening through the bottom of the plate and has shoulder surfaces adapted to engage the bearing surfaces. Additionally, the tool holder assembly includes tool receptacle means projecting generally radially from the removable support and adapted to receive a workpiece, and detent means including detent surfaces adapted to engage the surfaces defining the socket in the plate to position the plate at a predetermined location relative to the workpiece feed means. A detent means is mounted on the workpiece feed means for movement between a locking position with the detent surfaces of the detent means engaged with the socket in the plate, and a release position with the detent surfaces of the detent means disengaged with the socket to afford sliding movement of the support within the slot. A biasing means is provided to bias the detent surfaces of the detent means toward the locking position and to bias the shoulder surfaces of the plate radially outward toward engagement with the bearing surfaces on the periphery of the workpiece feed means to provide secure frictional engagement between the shoulder surfaces of the plate and the bearing surfaces of the slot to thereby firmly hold the support on the periphery of the workpiece feed means while the new surface is formed on the object or workpiece by the machining means. An actuation means is provided for moving the detent means from the locking position to the release position against the bias of the biasing means and for overcoming the secure frictional engagement between the shoulder surfaces of the plate and the bearing surfaces of the slot to thereby afford easy changing of the removable support and the tool receptacle means with a different removable support and tool receptacle means. Overcoming the bias of the biasing means before the removable plate is slid into or out of the slot eliminates the wear between the shoulder surfaces of the plate and the bearing surface of the slot during insertion and removal Preferably, the actuation means comprises an L-shaped actuating arm and the slot in the workpiece feed means has a uniform cross-section in planes normal to the axis of the wheel, such as, but not limited to a dovetail slot, an inverted T-shaped slot, an hourglass-shaped slot, an X-shaped slot and a machined rectangular slot. Alternatively, the slot in the workpiece feed mechanism may comprise a half dovetail slot.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
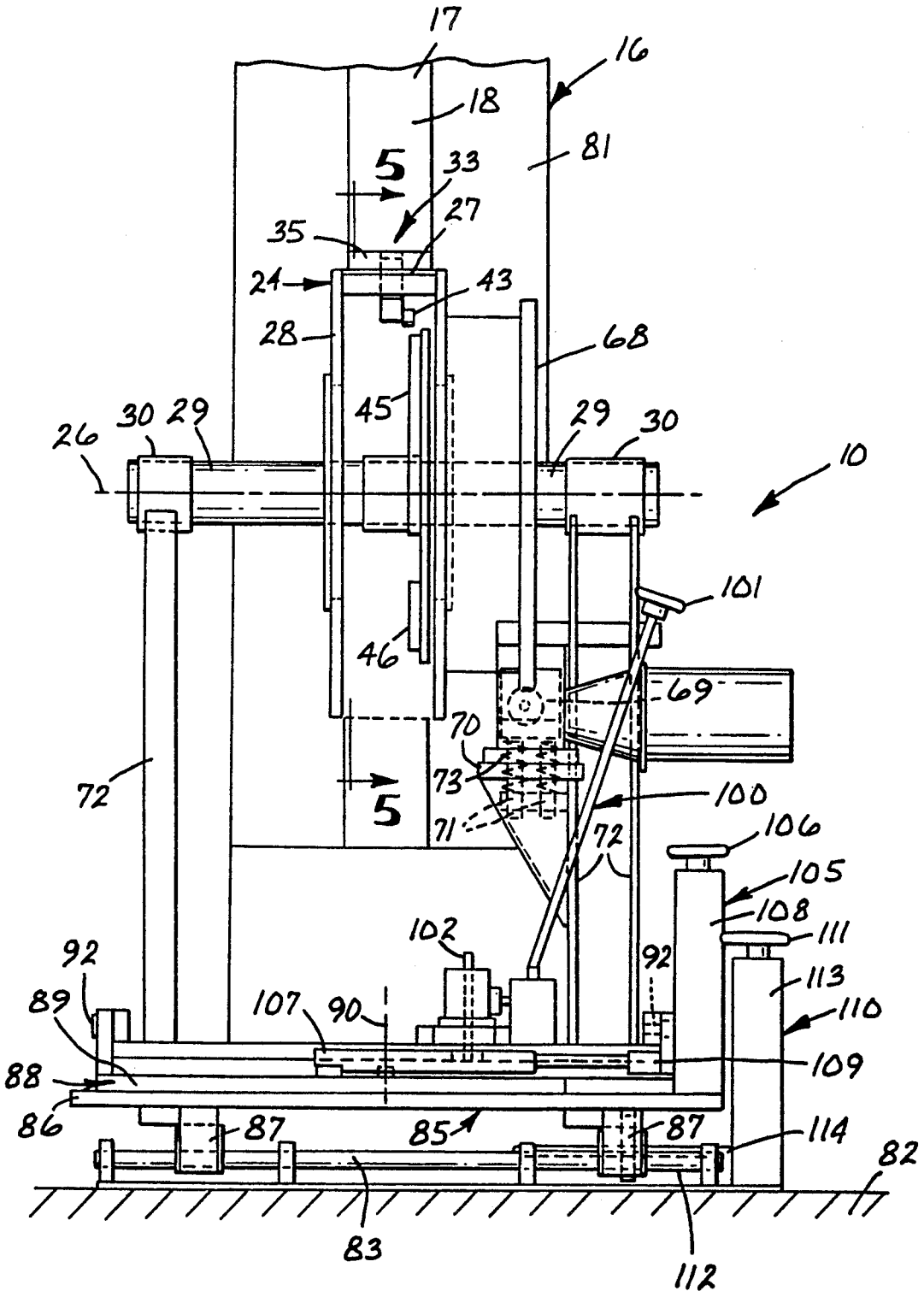
FIG. 1 is a fragmentary front vertical view of a machining means and a workpiece feed means for use with the present invention, which view has parts broken away to show details.
Figure 1A:
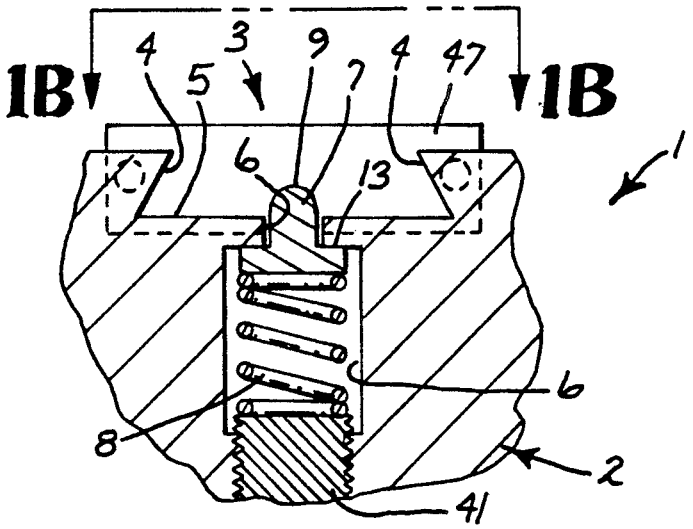
Fig. 1A PRIOR ART
FIG. 1A is a side view of elements of a prior art tool holder assembly with portions broken away to show detail.
Figure 1B:
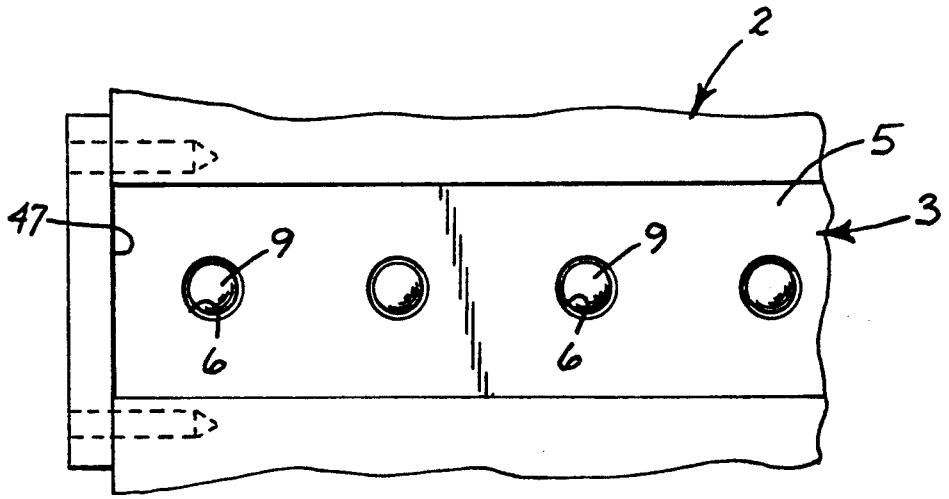
Fig. 1B PRIOR ART
FIG. 1B is a sectional view of the tool holder assembly of FIG. 1A taken approximately along lines 1B—1B of FIG. 1A.
Figure 2:
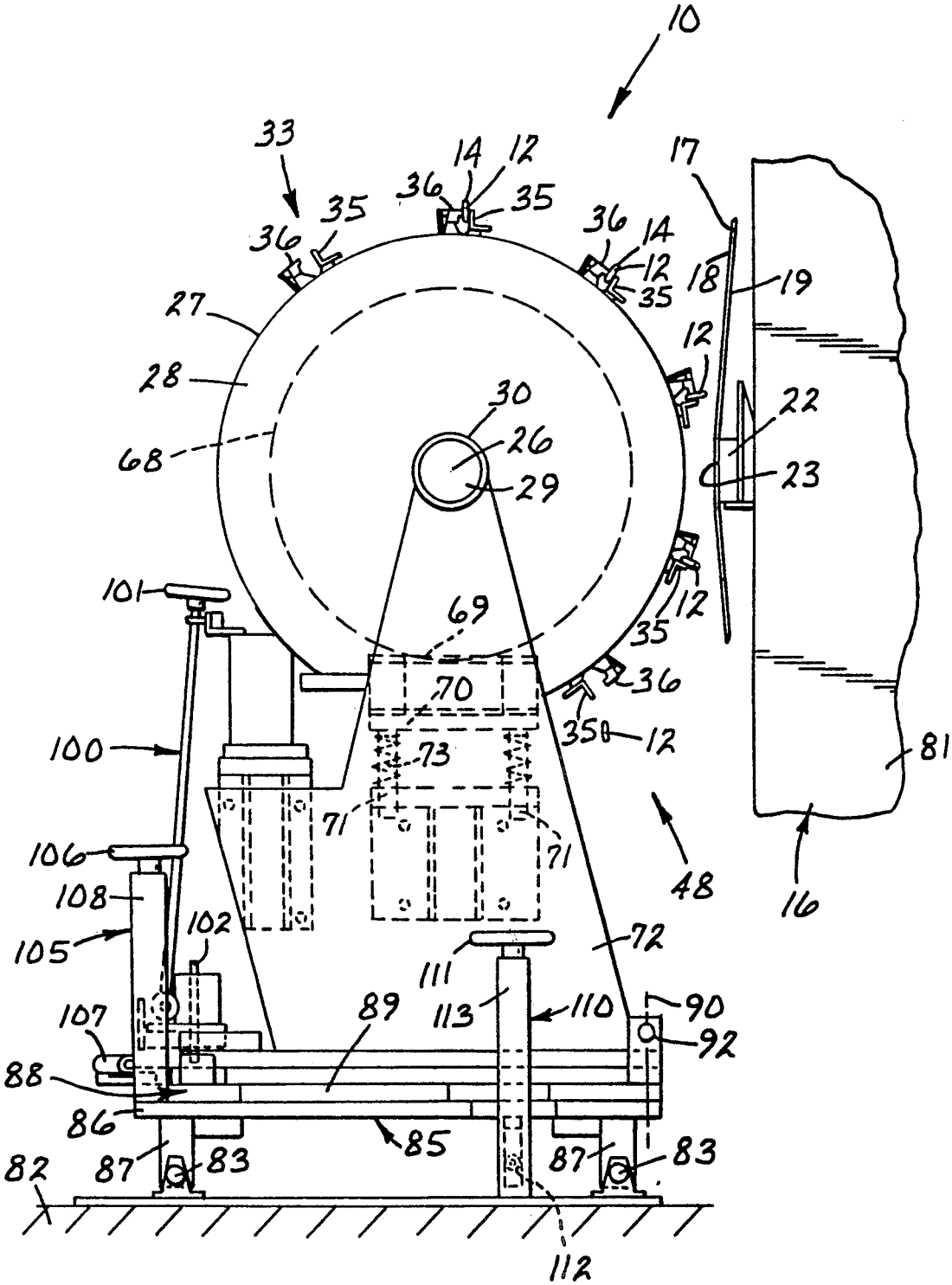
FIG. 2 is a fragmentary side vertical view of a machining means and workpiece feed means for use with the present invention.

Referring now to FIGS. 1 and 2 of the drawing, there is shown a workpiece feed means 10 adapted for use on an elongate bar or workpiece such as a wrench 12 illustrated having opposite major side surfaces and an initial edge surface 14 between the side surfaces that is rough and has a predetermined shape when viewed in the planes of the major surfaces that may not be linear along the length of the wrench 12. The workpiece feed means or mechanism 10 is adapted to grind the wrench 12 to form a new edge surface extending between the side surfaces that is smoothly arced while retaining the predetermined shape along the length of the wrench 12. It should be noted that while the workpiece feed means 10 is shown as a wheel 28 (see FIG. 3), the tool holder assembly 80 (FIG. 4) of the present invention may be used with any suitable workpiece feed means, such as, but not limited to turrets, universal chucks, belts, reciprocating beds, rise and fall grinders, rotary tables, and conveyer beds.

FIGS. 1 and 2 illustrate machining means including a belt driving mechanism 16 comprising a conventional continuous abrasive belt 17 having a flexible cloth backing with front and rear surfaces 18 and 19, and abrasive granules attached along its front surface 18 (e.g., the abrasive belt sold by Minnesota Mining and Manufacturing Company, St. Paul, Minn. under the trade designation 3M 331D "Three-M-ite" TM Resin Bond Cloth Belts), means for driving the abrasive belt 17 in a first direction along a path relative to frame means for the workpiece feed means 10 and the machining means in the form of a conventional belt drive mechanism (not shown) including spaced rollers around which the abrasive belt 17 is tensioned and a motor drive assembly that drives the rollers and thereby the abrasive belt 17 (e.g. the vertical slack belt machines sold by KLK Industries, Crystal, Minn., or G & P Industries, Indianapolis, Ind.); a backup platen 22 fixed to the frame means and having a support surface 23 along the path adjacent the rear surface 19 of the abrasive belt 17, which support surface 23 is straight in the first direction in which the abrasive belt 17 is driven (see FIG. 2) and has a uniform shape corresponding to the shape of the edge surface 14 in a direction at a right angle to the first direction in which the abrasive belt 17 is driven.

While the machining means illustrated includes an abrasive belt 17, it should be noted that the tool holder assembly 80 of the present invention may be used with any suitable machining means including but not limited to milling machines, bonded wheel surface grinders, polishing machines, emery wheels, precision grinders, pressure grinders, shapers, lathes, coated abrasive grinders, bonded abrasive grinders, and blanchard grinders.

The illustrated workpiece feed means comprises bar or workpiece manipulating means for moving the edge surface 14 of the wrench 12 at a uniform rate of speed along an arcuate path about an axis 26 at a right angle to the first direction in which the abrasive belt 17 is driven into forceful engagement with the abrasive belt 17 along the support surface 23. The bar manipulating means or workpiece feed means comprises a wheel 28 having an axis 26, a generally cylindrical periphery 27; means in the form of an axle 29 for the wheel 28 journaled in bearings 30 on the frame means mounting the wheel 28 on the frame means for rotation about the axis 26 at a right angle to the first direction in which the abrasive belt 17 is driven to sequentially move the periphery 27 of the wheel 28 past a loading station 33 relative to the frame means, and then past the support surface 23 of the platen 22; drive means for rotating the periphery 27 of the wheel 28 past the support surface 23 of the platen 22 at a uniform rate of rotation; clamp means comprising pairs of first and second spaced jaws 35 and 36 mounted on the wheel 28 in spaced relationship about its periphery 27 for relative movement between a release position (see the jaws 35 and 36 at the loading station 33) with the jaws 35 and 36 spaced to freely receive a wrench 12 between the jaws 35 and 36, and an engage position (see the jaws adjacent the platen 22) adapted to firmly clamp the wrench 12 between the jaws 35 and 36; and jaw actuating means (later to be explained) for positioning the jaws 35 and 36 in their release position at the loading station 33, and for positioning the jaws 35 and 36 in their engage position as each clamp assembly moves past the support surface 23 of the platen 22.

Figure 4:
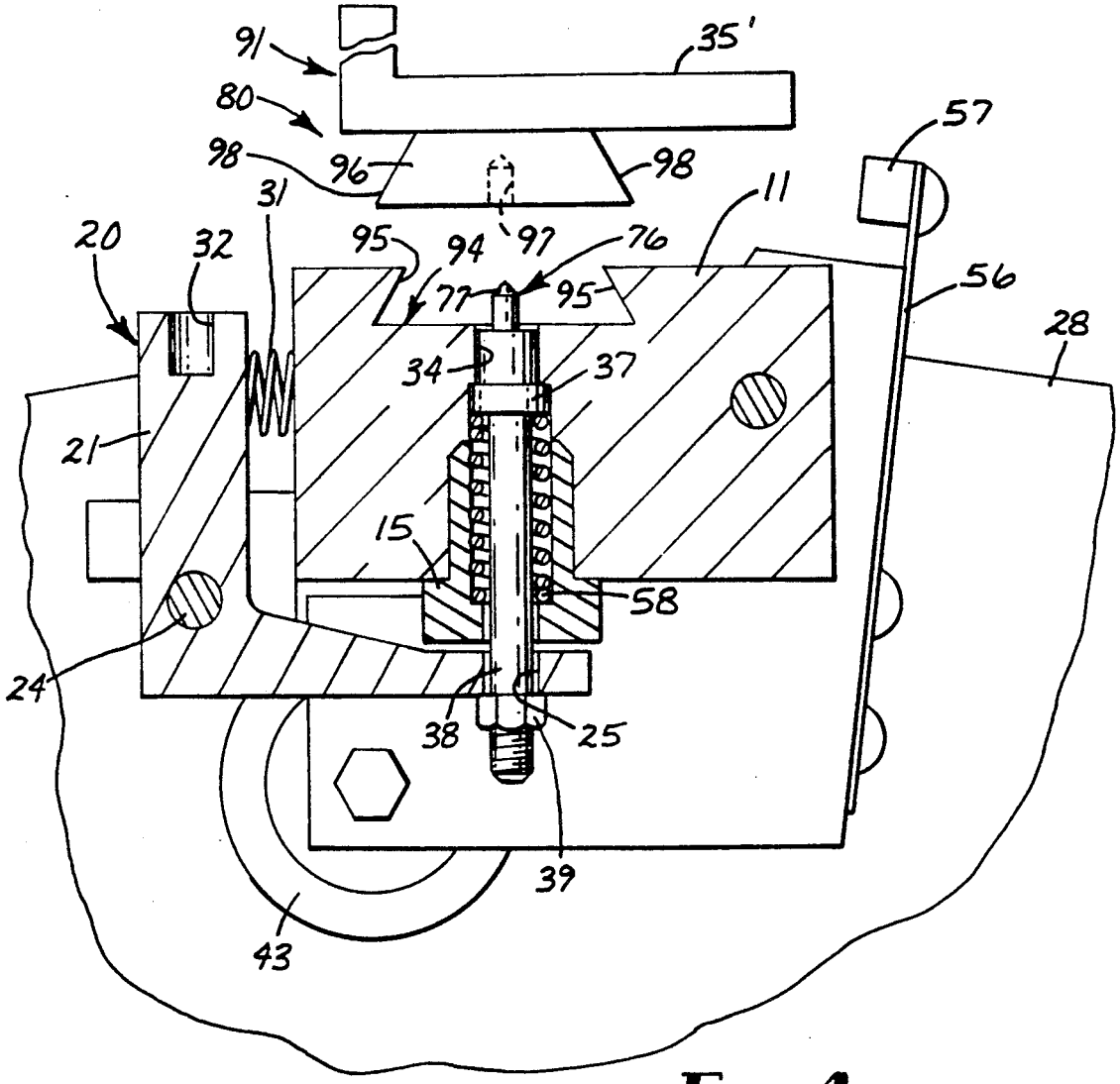
FIG. 4 is a sectional view of the tool holder assembly of the present invention taken approximately along lines 4—4 of FIG. 3 and further illustrating a plate and tool receptacle according to the present invention.

For each pair of jaws 35 and 36 the first or fixed jaw 35 is releasably attached to the periphery 27 of the wheel 28 in a fixed position by a first embodiment of the tool holder assembly according to the present invention generally designated by the reference character 80. As best seen in FIG. 4, the tool holder assembly 80 comprises the workpiece feed means having slot surfaces 94 (FIG. 4) defining an opening extending axially through a peripheral portion of the workpiece feed means. Those surfaces include bearing surfaces 95 diverging on opposite sides of the opening. The tool holder assembly also comprises a removable support including a plate 96 adapted to be received in the slot 94. The plate 96 has surfaces defining a socket 97 opening through the bottom of the plate and has shoulder surfaces 98 adapted to engage the bearing surfaces 95. Additionally, the tool holder assembly includes tool receptacle means 91 which includes the stationary jaw 35'. The tool receptacle means 91 projects generally radially from the plate 96 and are adapted to receive a workpiece, such as the wrench 12.

Detent means 76 including detent surfaces 77 is adapted to engage the surfaces defining the socket 97 in the plate 96 to position the plate 96 at a predetermined location relative to the periphery of the workpiece feed means (i.e. the wheel 28). The detent means 76 is mounted on the workpiece feed means for movement between a locking position with the detent surfaces 77 of the detent means 76 engaged with the socket surfaces 97 in the plate 96, and a release position with the detent surfaces 77 of the detent means 76 disengaged or spaced from the socket 97 to afford sliding movement of the plate 96 within the slot 94.

Figure 3:
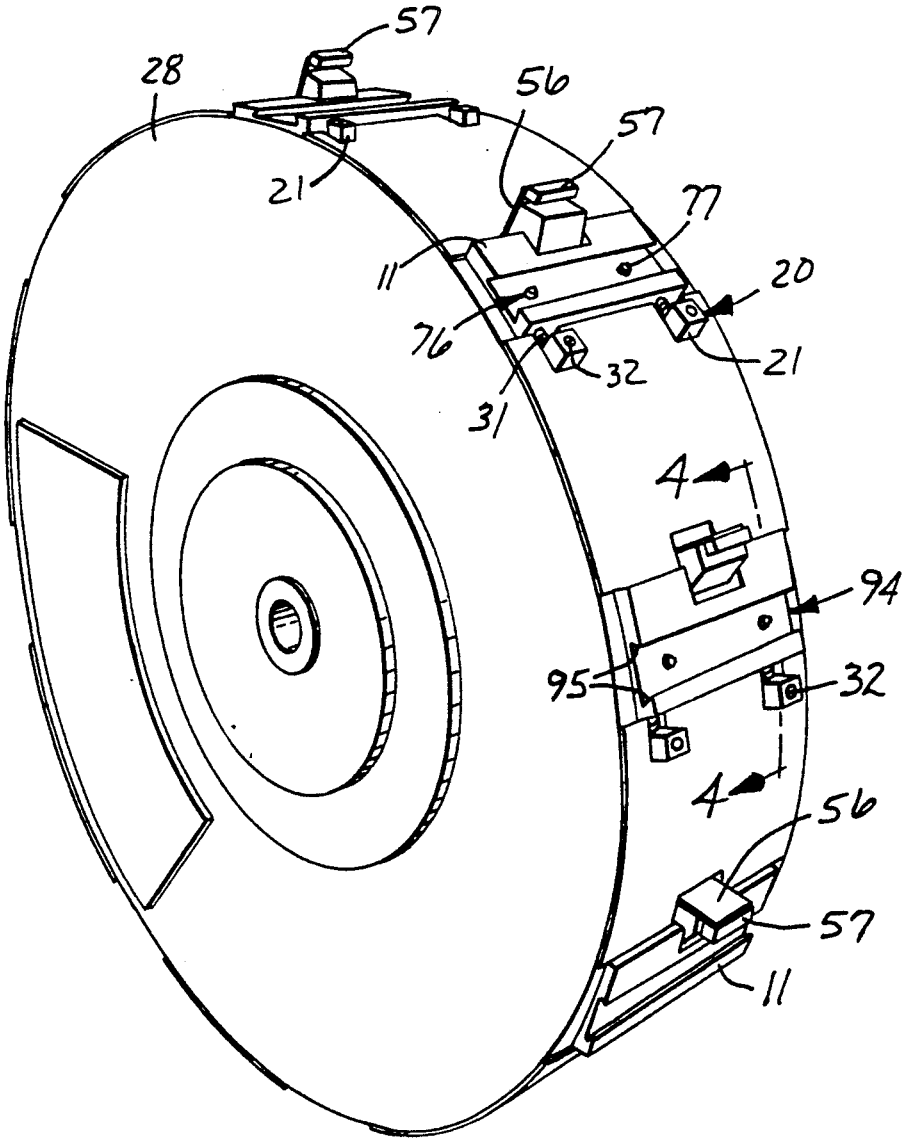
FIG. 3 is a perspective view of a workpiece feed means in the form of a wheel showing portions of a first embodiment of tool holder assembly according to the present invention with portions omitted to show detail.

FIG. 3 illustrates two detent surfaces 77. However, any number of detent surfaces may be used including a single detent surface. The number of detent means 76 used will depend upon a variety of factors such as the constraints of the particular machining means and workpiece feed means utilized in conjunction with the tool holder assembly of the present invention. FIG. 3 also illustrates the detent surfaces 77 located approximately along a middle portion of the slot 94. However, any suitable configuration for the detent surfaces 77 may be utilized including having the detent surfaces offset from the middle portion of the slot 94.

The detent means 76 may include a cylindrical rod 38 having an axis and having opposite ends with one end located adjacent the detent surfaces 77 and with the other end of the rod 38 being threaded to receive a nut 39. The rod 38 includes a flange 37; and the rod 38 is located within a bore 34 in a tool holder assembly frame 11 and is adapted to move along its axis within the bore 34 when the detent means 76 are moved between the locking and release positions. Alternatively, the nut 39 of the embodiment shown in FIG. 4 may be replaced by any suitable means such as, but not limited to, set collars, washer and cotter keys, welded pins.

Biasing means may be provided in the form of a compression coil spring 58 for each of the detent surfaces 77 that biases the detent surfaces 77 of the detent means 76 toward the locking position. The springs 58 also bias the shoulder surfaces 98 of the plate 96 radially outward from the axis 26 (see FIG. 2 for example) toward engagement with the bearing surfaces 95 on the periphery of the slot 94 to provide secure frictional engagement between the shoulder surfaces 98 of the plate 96 and the bearing surfaces 95 of the slot 94 to thereby firmly hold the plate 96 within the slot 94 while the new surface is formed on the object or workpiece (i.e. a wrench 12) by the machining means.

The coil springs 58 have two opposite ends with one end engaged with the flange 37 on the rod 38 and with the other end of the springs 58 engaged with plugs 15 attached to the tool holder assembly frame 11. The plugs 15 may be attached to the tool holder assembly frame 11 by threading the plugs 15 and the bore of the tool holder assembly frame 11 that receives the plugs 15 and thereafter screwing the plugs 15 into the bores. The biasing means need not be coil springs 58 but could instead comprise any suitable biasing means such as but not limited to torsion springs, leaf springs, tension coil springs, pneumatic or hydraulic cylinders, set screws or wedges.

An actuation means 20 is provided for moving the detent means 76 from the locking position to the release position against the bias of the coil springs 58 and for overcoming the secure frictional engagement between the shoulder surfaces 98 of the plate 96 and the bearing surfaces 95 of the slot 94 to thereby afford efficient changing of the plate 96 and the tool receptacle means 91 with a different plate and tool receptacle means. The actuation means 20 affords release of the bias from the springs 58 before the plate 96 is slid axially into or out of slot 94.

Preferably, the actuation means 20 may include an L-shaped actuating arm 21 having upper and lower ends. The L-shaped actuating arm 21 is mounted on the workpiece feed means and engages the detent means 76 for movement of the detent means 76 between the locking and release position. Biasing means in the form of a coil spring 31 is provided to urge the L-shaped arm 21 away from engagement with the detent means to thereby prevent the actuation means from inadvertently or accidentally releasing the tool holder assembly at an inopportune time, such as during machining of the workpiece (i.e. the wrench 12). The coil spring 31 also prevents the arm 21 from rattling during movement of the wheel 28.

At its lower end the L-shaped actuating arm 21 includes an aperture 25. The cylindrical rod 38 is adapted to pass through the aperture 25 in the L-shaped actuating arm 21 so that the nut 39 may engage surfaces of the arm 21. At the upper end, the L-shaped actuating arm 21 includes surfaces defining a pair of apertures 32 which are adapted to receive a manual operable means (not shown) for moving the detent means 76 from the locking to the release position to afford changing of the plate 96 and the stationary jaw 35' with a different plate and stationary jaw. The manual operable means may comprise a fork shaped bar having two tangs projecting from a handle. The outer ends of the tangs are shaped to be received by the apertures 32 at the upper end of the L-shaped arm 21. It should be noted that while a manual operable means is described above, the present invention is intended to be used with any suitable means including automatic and manual means.

During use, to replace an existing plate 96 and tool receptacle means 91 (which includes the stationary jaw 35') with a different plate and tool receptacle means, an operator first fits the tangs of the fork shaped bar into the apertures 32 and move the upper end of the L-shaped arm 21 toward the tool holder assembly frame 11. Such action of the arm 21 causes the arm to pivot about pin 24 and also causes the lower end of the arm to engage the nut 39. Engagement between the lower end of the arm 21 and the nut 39 draws the rod 38 axially downward and thereby causes the detent means 76 to move from the locking to the release position. Once the detent means 76 has been moved to the release position, the plate 96 and tool receptacle means 91 may be quickly and relatively easily slid from the slot 94.

Figure 4A:
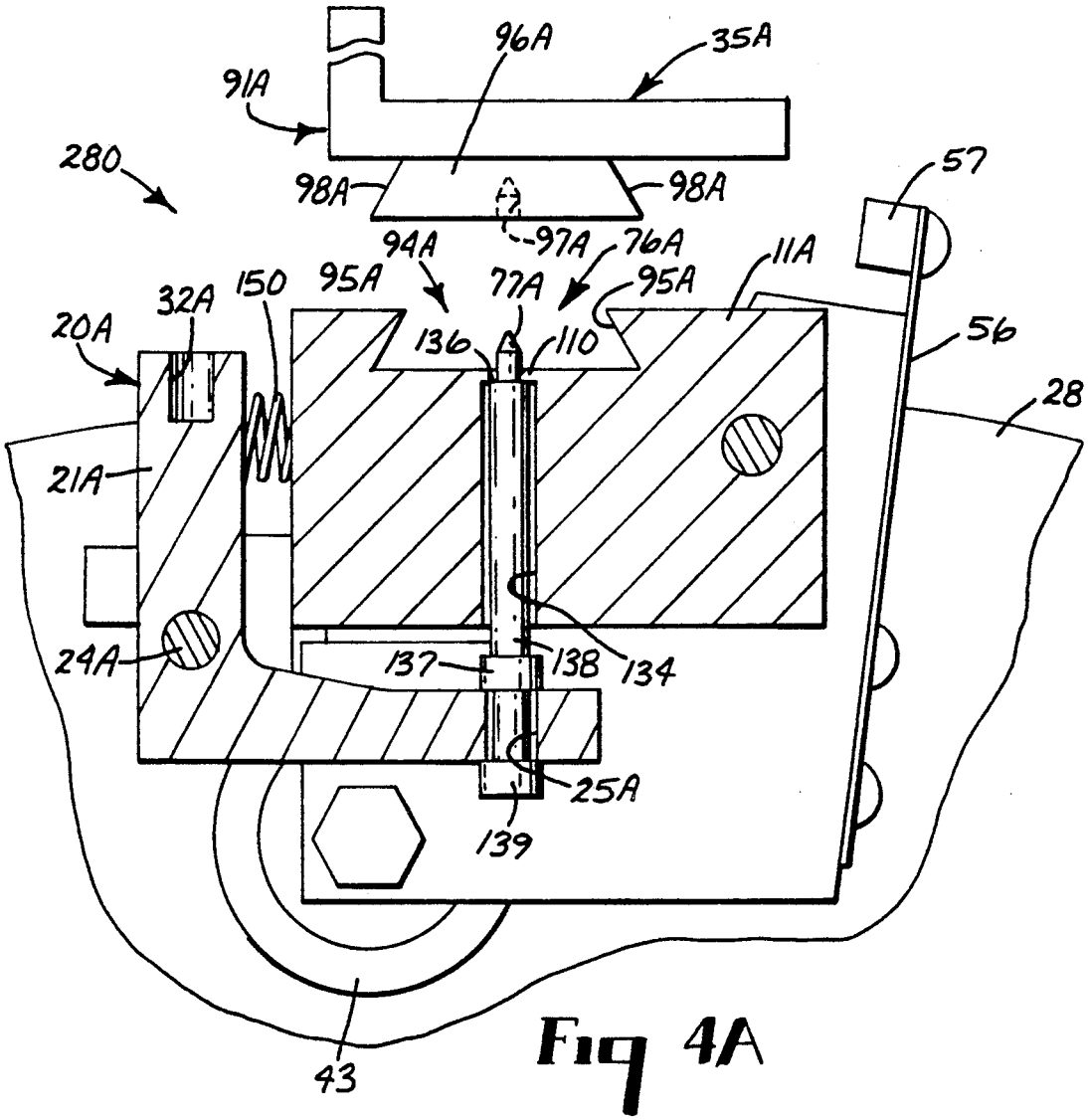
FIG. 4A is a sectional view of a second embodiment of tool holder assembly according to the present invention.

FIG. 4A illustrates a second alternative embodiment of tool holder assembly according to the present invention with the tool holder assembly generally designated by the reference character 280 which has many parts that are essentially the same as the parts of the tool holder assembly 80 and which have been identified by the same reference number to which the suffix "A" has been added.

Like the tool holder assembly 80 described in FIG. 4, the tool holder assembly shown in FIG. 4A comprises the workpiece feed means having slot surfaces 94A defining an opening extending axially through a peripheral portion of the workpiece feed means. Those surfaces include bearing surfaces 95A diverging on opposite sides of the opening. The tool holder assembly 280 comprises a removable support including a plate 96A adapted to be received in the slot 94A. The plate 96A has surfaces defining a socket 97A opening through the bottom of the plate and has shoulder surfaces 98A adapted to engage the bearing surfaces 95A. Additionally, the tool holder assembly includes tool receptacle means 91A which includes the stationary jaw 35A. The tool receptacle means 91A projects generally radially from the plate 96A and are adapted to receive a workpiece, such as the wrench 12.

Also like the tool holder assembly 80, the tool holder assembly 280 includes detent means 76A including detent surfaces 77A adapted to engage the surfaces defining the socket 97A in the plate 96A to position the plate 96A at a predetermined location relative to the periphery of the wheel 28. The detent means 76A is mounted on the wheel 28 for movement between a locking position with the detent surfaces 77A of the detent means 76A engaged with the socket surfaces 97A in the plate 96A, and a release position with the detent surfaces 77A of the detent means 76A disengaged from the socket 97A to afford sliding movement of the plate 96A within the slot 94A.

Unlike the tool holder assembly 80, the detent means 76A of the tool holder assembly 280 include a cylindrical rod 138 having an axis and having opposite ends with one end located adjacent the detent surfaces 77A and with the other end of the rod 138 having a pair of flanges 137 and 139. The rod 138 includes shoulder portions 136; and the rod 138 is located within a bore 134 in a tool holder assembly frame 11A which includes lip surfaces 110 which are adapted to engage the shoulder portions 136 to restrict the projection of the cylindrical rod 138 into the slot 94A. The rod 138 is adapted to move along its axis within the bore 134 when the detent means 76A is moved between the locking and release positions. Alternatively, the lip surfaces 110 and shoulder 136 may be omitted if flange 137 is used to restrict the projection of the rod 138.

Also unlike the tool holder assembly 80, the biasing means of the tool holder assembly 280 comprises only coil spring 150 that biases the detent surfaces 77A of the detent means 76A toward the locking position. The spring 150 also biases the shoulder surfaces 98A of the plate 96A radially outward from the axis 26 toward engagement with the bearing surfaces 95A on the periphery of the slot 94A to provide secure frictional engagement between the shoulder surfaces 98A of the plate 96A and the bearing surfaces 95A 20 of the slot 94A to thereby firmly hold the plate 96A within the slot 94A while the new surface is formed on the object or workpiece by the machining means.

The coil spring 150 has two opposite ends with one end engaged with an L-shaped actuation member 21A and with the other end of the spring engaged with the tool holder assembly frame 11A. The L-shaped actuation member 21A is part of an actuation means 20A which is provided for moving the detent means 76A from the locking position to the release position against the bias of the spring 150 and for overcoming the secure frictional engagement between the shoulder surfaces 98A of the plate 96A and the bearing surfaces 95A of the slot 94A to thereby afford quick changing of the plate 96A and the tool receptacle means 91A with a different plate and tool receptacle means. The actuation means 20A affords release of the bias from the spring 150 before the plate 96A is slid axially into or out.

Like the tool holder assembly 80, the actuation means 20A comprises the L-shaped actuating arm 21A having upper and lower ends. The L-shaped actuating arm 21A is mounted on the workpiece feed means and its lower end engages the flanges 137 and 139 of the rod 138 for movement of the detent means 76A between the locking and release position.

At its lower end the L-shaped actuating arm 21A includes an aperture 25A. The cylindrical rod 138 is adapted to pass through the aperture 25A in the L-shaped actuating arm 21A so that the flanges 137 and 139 may engage surfaces of the arm 21A. At the upper end, the L-shaped actuating arm 21A includes surfaces defining a pair of apertures 32A which are adapted to receive a manual operable means (not shown) such as a fork shaped bar having two tangs projecting from a handle for moving the detent means 76A from the locking to the release position to afford changing of the plate 96A and the stationary jaw 35A with a different plate and stationary jaw.

Figure 4B:
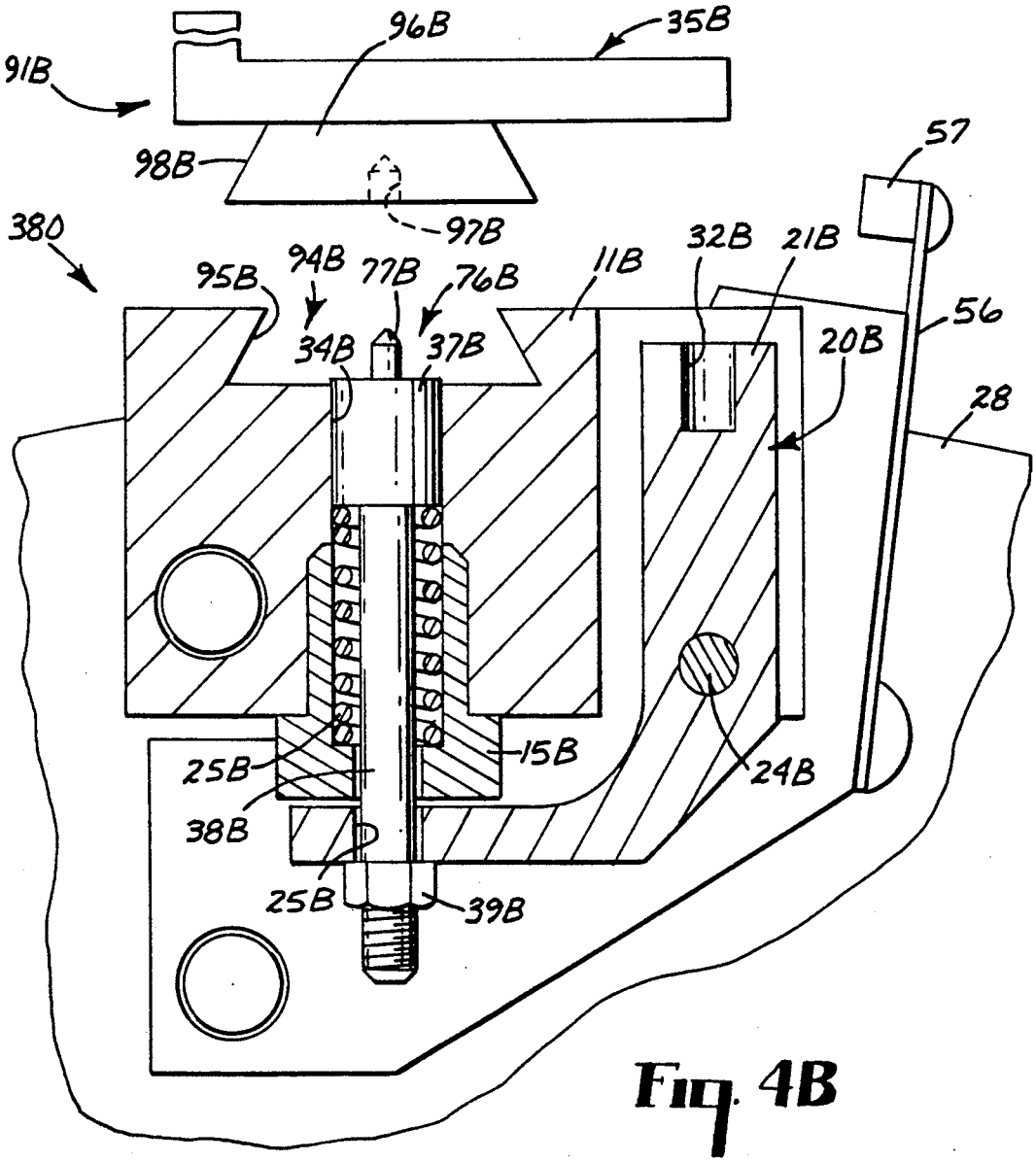
FIG. 4B is a sectional view of a third embodiment of tool holder assembly according to the present invention.

FIG. 4B illustrates a third alternative embodiment of tool holder assembly according to the present invention with the tool holder assembly generally designated by the reference character 380 which has many parts that are essentially the same as the parts of the tool holder assembly 80 and which have been identified by the same reference number to which the suffix "B" has been added.

Like the tool holder assembly 80 described in FIG. 4, the tool holder assembly shown in FIG. 4B comprises the workpiece feed means having slot surfaces 94B defining an opening extending axially through a peripheral portion of the workpiece feed means. Those surfaces include bearing surfaces 95B diverging on opposite sides of the opening The tool holder assembly 380 comprises a removable support including a plate 96B adapted to be received in the slot 94B. The plate 96B has surfaces defining a socket 97B opening through the bottom of the plate and has shoulder surfaces 98B adapted to engage the bearing surfaces 95B. Additionally, the tool holder assembly includes tool receptacle means 91B which includes the stationary jaw 35B The tool receptacle means 91B projects generally radially from the plate 96B and are adapted to receive a workpiece, such as the wrench 12.

Also like the tool holder assembly 80, the tool holder assembly 380 includes detent means 76B including detent surfaces 77B adapted to engage the surfaces defining the socket 97B in the plate 96B to position the plate 96B at a predetermined location relative to the periphery of the wheel 28. The detent means 76B is mounted on the wheel 28 for movement between a locking position with the detent surfaces 77B of the detent means 76B engaged with the socket surfaces 97B in the plate 96B, and a release position with the detent surfaces 77B of the detent means 76B disengaged from the socket 97B to afford sliding movement of the plate 96B within the slot 94B. Additionally, like the tool holder assembly 80, the detent means 76B of the tool holder assembly 380 includes a cylindrical rod 38B having an axis and having opposite ends with one end located adjacent the detent surfaces 77B and with the other end of the rod 38B being threaded to receive a nut 39B. The rod 38B includes a flange 37B; and the rod 38B is located within a bore 34B in a tool holder assembly frame 11B and is adapted to move along its axis within the bore 34B when the detent means 76B is moved between the locking and release positions.

Unlike the tool holder assembly 80, a biasing means is provided for the tool holder assembly 380 in the form of coil springs 258 that bias the detent surfaces 77B of the detent means 76B toward the locking position. The springs 258 also bias the shoulder surfaces 98B of the plate 96B radially outward from the axis 26 toward engagement with the bearing surfaces 95B on the periphery of the slot 94B through a flange on the rod or pin 38B to provide secure frictional engagement between the shoulder surfaces 98B of the plate 96B and the bearing surfaces 95B of the slot 94B to thereby firmly hold the plate 96B within the slot 94B while the new surface is formed on the object or workpiece by the machining means.

The coil springs 258 have two opposite ends with one end engaged with the flange 37B on the rod 38B and with the other end of the spring 258 engaged with a plug 15B screwed to the tool holder assembly frame 11B.

Also unlike the tool holder assembly 80, the biasing means of the tool holder assembly 380 comprises only coil springs 258 to bias the detent surfaces 77B of the detent means 76B toward the locking position.

The position of the actuation means 20B is opposite the position of the actuation means 20 of the tool holder assembly 80. The actuation means 20B comprises an L-shaped actuating arm 21B having upper and lower ends. At its lower end the L-shaped actuating arm 21 includes an aperture 25B. The cylindrical rod 38B is adapted to pass through the aperture 25B in the L-shaped actuating arm 21B so that the nut 39B may engage surfaces of the arm 21B. At the upper end, the L-shaped actuating arm 21B includes surfaces defining a pair of apertures 32B which are adapted to receive a manual operable means such as a fork shaped bar having two tangs projecting from a handle for moving the detent means 76B from the locking to the release position to afford changing of the plate 96B and the stationary jaw 35B with a different plate and stationary jaw.

Figure 5:
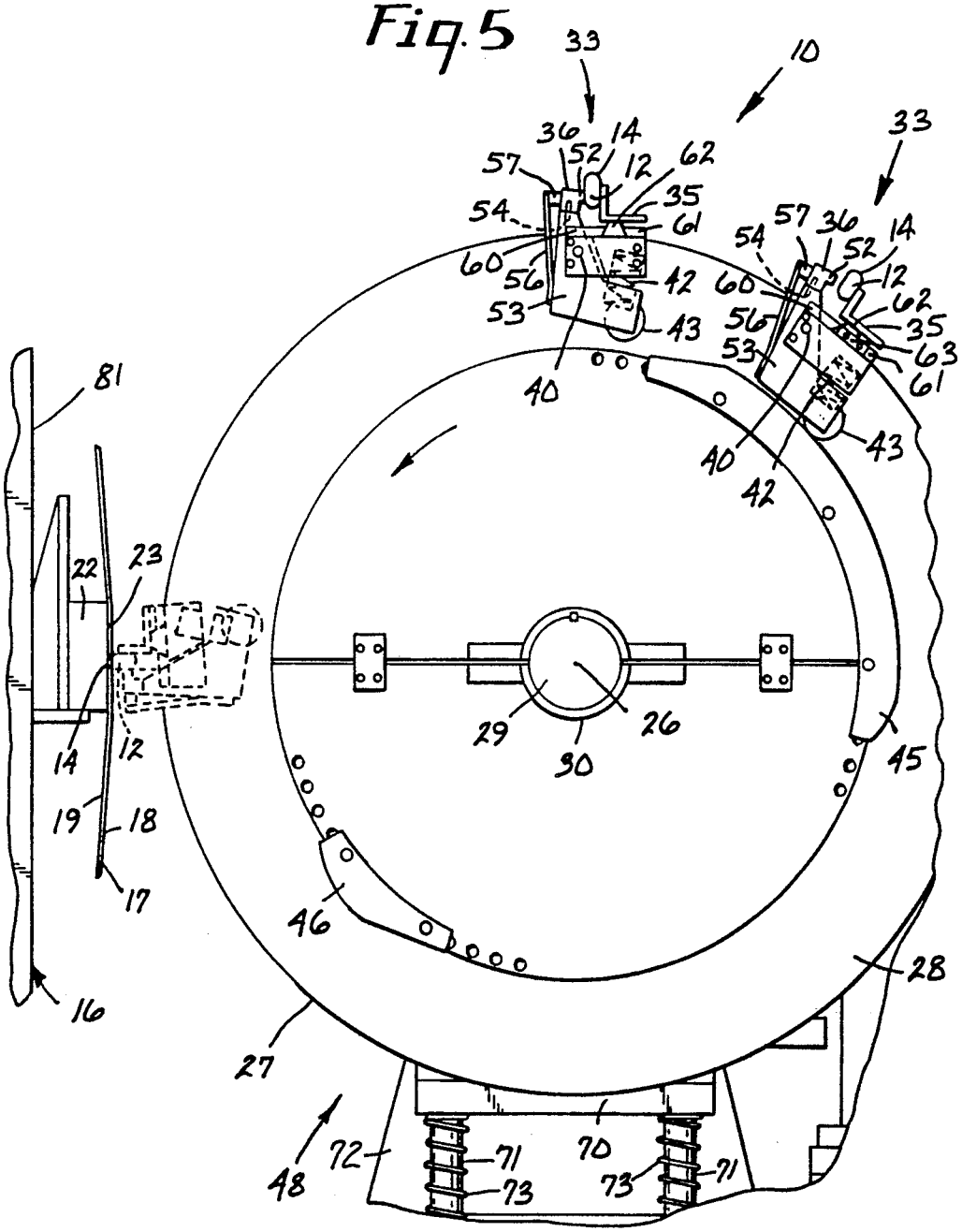
FIG. 5 is an enlarged fragmentary side vertical view of a fourth embodiment of tool holder assembly according to the present invention taken approximately along lines 5—5 of FIG. 1.

Referring now to FIGS. 1, 2 and 5, the second or movable jaw 36 is mounted on the wheel 28 by means including a pivot pin 40 for pivotal movement relative to the wheel 28 and fixed jaw 35 between the release and the engage positions; and the jaw actuating means includes a spring 42 between the fixed jaw 35 and the movable jaw 36 for biasing the movable jaw 36 toward the engage position of the jaws 35 and 36. Cam means are present and include a cylindrical cam follower 43 mounted on the movable jaw 36 for rotation about an axis parallel to the axis 26 of the wheel 28, and first and second cams 45 and 46 mounted on the frame means, which cams 45 and 46 have cam surfaces positioned for engagement by the cam followers 43 to position the movable jaws 36 in the release positions of the jaws 35 and 36 when the pairs of jaws 35 and 36 are at the loading station 33 preceding the platen 22 or at an unloading station 48 subsequent to the platen 22 and fixed relative to the frame means along the lowermost portion of the wheel 28, and past which unloading station 48 the pairs of jaws 35 and 36 are moved after movement from the loading station 33 past the support surface 23 of the platen 22 so that the finished wrench 12 can be dropped into a receptacle at the unloading station 48.

Each pair of jaws 35 and 36 is shaped to position the wrench 12 at a predetermined position there between, such as through the use of a pin (not shown) received between jaws of the wrench 12 and a pin for supporting the edge surface of the wrench 12 opposite the edge surface 14 being radiused by the machining means or grinding assembly 10. Different shaped jaws 35 and 36 may thus be required for different shaped wrenches, and the use of such different shaped jaws is facilitated by the tool holder assembly 80 described above.

A means is provided for changing a minor contact portion 52 of the movable jaw 36 that is shaped to engage a particular wrench or other workpiece. That means for changing the contact portion 52 of the movable jaw 36, best seen in FIG. 5, comprises the movable jaw 36 having a major portion 53 pivotably mounted on the pivot pin 40 and on which major portion 53 the cam follower 43 is mounted, which major portion 53 has a pivotable support pin 54 projecting generally centrally and radially of the wheel 28, on which pivotable support pin 54 the minor contact portion 52 of the movable jaw 36 is pivotably mounted. Pivotal movement of the minor contact portion 52 of the movable jaw 36 around the pin 54 insures complete contact of the movable jaw 36 with the wrench 12 between the jaws 35 and 36. The minor contact portion 52 of the movable jaw 36 is retained in place on the pin 54 and against the major portion 53 by a leaf spring 56 having an end portion fixed on the major portion 53 of the movable jaw 36, and carrying a lug 57 on its distal end adapted to engage over a lip on the minor contact portion 52 of the movable jaw 36 When desired, the contact portion 52 can be easily replaced by a contact portion of a different shape by pulling the lug 57 out of the recess in the contact portion 52 of the movable jaw 36 against the bias of the spring 56, lifting the contact portion 52 off of the pin 54, positioning the new contact portion on the pin 54, and allowing the lug 57 to enter the recess in the new contact portion under the influence of the spring 56 to retain it in place.

A fourth alternative embodiment of tool holding means of the present invention is shown in FIG. 5 and comprises means for releasably attaching the first or fixed jaw 35 of each pair of jaws to the periphery 27 of the wheel 28. That means comprises structural means in the form of spaced metal bars 60 and 61 attached transversely along the periphery 27 of the wheel 28 and adapted, together with a cylindrical outer portion of the wheel 28, to define a slot extending generally parallel to the axis 26 of the wheel 28 and having an inlet opening at the end of the slot viewed in FIG. 5. The fixed jaw 35 has a plate or base 62 generally similar to the plate 96 described in conjunction of the first embodiment of tool holder assembly The plate or base 62 is adapted for close fitting engagement in the slot, and means including a lever 63 pivotable to a position projecting across the open end of the slot from a position spaced from the open end of the slot is provided for releasably retaining the plate or base 62 of the fixed jaw 35 in the slot. The side surfaces of at least one and preferably both of the bars 60 and 61 defining the side surfaces of the slot are disposed at an acute angle relative to the outer surface of the cylindrical portion of the wheel 28. The means for releasably retaining the plate or base 62 in the slot further includes means for forcefully pressing the base 62 against one or both of those side surfaces of the bars 60 and 61, which could be a set screw transversely through the bar 61, or alternately (not shown) could include mounting the bar 61 for limited sliding movement in a direction transverse to the slot, spring biasing the bar 61 toward the bar 60, and providing slots in the bar 61 and wheel 28 which would receive the end of a screwdriver by which the bar 61 could be moved away from the bar 60 against the biasing of such springs to permit insertion and removal of the base 62.

The backup platen 22, which has a uniform shape corresponding to the shape of the edge surface 14 in a direction at a right angle to the first direction in which the abrasive belt 17 is driven, may also be changed for different shaped wrenches or workpieces, and thus is removably attached to the frame means by bolts (not shown). The support surface 23 of the platen 22 along the path adjacent the rear surface of the abrasive belt 17 is covered with an about ⅛ inch thick layer of the graphite covered backing sold by Process Engineering Corporation, Crystal Lake, Ill., which facilitates sliding movement of the backing of the abrasive belt 17 along the fixed support surface 23 when the wrench 12 is pressed into forceful grinding engagement with the abrasive belt 17 moving over it.

The wheel 28 has a predetermined diametrical dimension (e.g., 76 centimeters or 30 inches) at its periphery 27, and the drive means for rotating the periphery 27 of the wheel 28 past the support surface 23 of the platen 22 at a uniform rate of rotation comprises a helical gear 68 coaxial with and fixed to the wheel 28 (which helical gear 68 has diametrical dimension of about 61 centimeters or 24 inches, which is, as is preferred, within 25 centimeters or 10 inches of the diametrical dimension of the wheel 28), a worm gear 69 having an axis at a right angle to the axis 26 of the helical gear 68 and wheel 28, which worm gear 69 is engaged with the helical gear 68 and is driven by a variable speed motor (not shown), means for mounting the worm gear 69 for radial movement relative to the helical gear 68, and means for biasing the teeth of the worm gear 69 into close fitting engagement with the teeth of the helical gear 68 to restrict backlash between the gears 68 and 69. The means for mounting the worm gear 69 for radial movement relative to the helical gear 68 and the means for biasing the teeth of the worm gear 69 into engagement with the teeth of the helical gear includes a portion 70 of the frame means on which the worm gear 69 is rotatably mounted, which frame means portion 70 includes a plurality of parallel pins 71 projecting at a right angle to the axis of the worm gear 69 and received for longitudinal sliding movement in sockets in a portion 72 of the frame means on which the wheel 28 is mounted, and coil springs 73 around the pins 71 between the frame portion 72 on which the wheel 28 is mounted and the frame portion 70 on which the worm gear 69 is mounted.

Means in the form of relatively movable portions of the frame means and adjustable mechanisms between those portions are also provided for providing precise alignment between the wrench 12 in the jaws 35 and 36 and the support surface 23 so that the wrench 12 will be brought into the desired engagement with the abrasive belt 17 along the support surface 23 to form the desired radius on the edge surface 14. The relatively movable portions of the frame means include (1) a fixed portion comprising a frame 81 of the belt driving mechanism 16, a floor 82 on which the frame 81 is mounted in a fixed position, and two parallel rail assemblies 83 supported in a fixed position on the floor 82; (2) a transversely movable portion 85 comprising a transversely movable plate 86 and four linear bearing assemblies 87 projecting from a bottom surface of the plate 86, which linear bearing assemblies 87 are mounted around the rail assemblies 83 for linear movement there along; a horizontally pivotable portion 88 comprising a horizontal pivot plate 89 laying in face to face contact with the upper surface of the transversely movable plate 86 and mounted by a bolt through the plates 86 and 89 for horizontal pivotal movement relative to the transversely movable plate 86 about a vertical pivot axis 90 closely adjacent to and generally centered on the abrasive belt 17; and the portion 72 which is vertically pivotable relative to the pivot plate 86 about a horizontal axis parallel to the axis 26 of the wheel 28 that is defined by pivot pins 92 through the vertically pivotable portion 72 and the horizontal pivot plate 89 on the sides thereof adjacent the abrasive belt 17.

An adjustment assembly 100 manually operable by a wheel 101 is mounted on the vertically pivotable portion 72 of the frame means and includes a screw jack portion including a threaded axially movable rod 102 having a lower end bearing against horizontal pivot plate 89 (e.g., the screw jack commercially designated a "Jaculator" TM available from Minnesota Bearing, St. Paul, Minn.). Rotation of the wheel 101 changes the length of the portion of the rod 102 that extends between the vertically pivotable portion 72 and the horizontal pivot plate 89, thereby causing vertical pivotal movement of the vertically pivotable portion 72 relative to the horizontal pivot plate 89 about the pivot pins 92 and changing the engagement between the edge surface 14 of the wrench 12 and the abrasive belt 17 on the support surface 23 along the entire length of the wrench 12.

An adjustment screw assembly 105 is manually operable by a wheel 106 connected to a shaft rotatably mounted in a bearing block 108 mounted on the transversely movable plate 86 of the frame means, which shaft is coupled by a universal joint 109 to an extendible or retractable rod assembly 107 having an end attached to the horizontal pivot plate 89. Rotation of the wheel 106 provides means for changing the length of the rod assembly 102 (i.e., by screwing a threaded rod portion thereof into or out of an internally threaded socket portion thereof) thereby causing horizontal pivotal movement of the horizontal pivot plate 89 and the wheel 28 carried thereby about the vertical pivot axis 90 on the top surface of the transversely movable plate 86 to adjust the engagement of one end of the wrench 12 relative to the other with the abrasive belt 17 along the support surface 23.

An adjustment screw assembly 110 is manually operable by a wheel 111 connected to a shaft rotatably mounted in a bearing block 113 mounted on a plate fixed to the floor 82 on which the rail assemblies 83 are fixed, which shaft is coupled by a universal joint 114 to an extendible or retractable rod assembly 112 having an end attached to the transversely movable plate 86 of the frame means. Rotation of the wheel 111 provides means for 20 changing the length of the rod assembly 112 (i.e., by screwing a threaded rod portion thereof into or out of an internally threaded socket portion thereof), thereby causing horizontal movement of the transversely movable plate 86 and the wheel 28 it supports through the pivotal portion 88 to adjust the area of contact between the wrench 12 and the abrasive belt 17 along the platen 22 in a direction parallel to the axis 26 of the wheel 28.

It will be apparent to those skilled in the art that many changes can be made to the machining means and the workpiece feed means described without departing from the scope of the present invention. For example, when the grinding assembly is used to radius a straight edge portion on a workpiece such as a bar or wrench, the abrasive belt used need not have a flexible backing. Instead of the platen 22, the abrasive belt 17 could be backed by a wheel having a specially shaped or cylindrical periphery, depending on the shape of the bar or wrench to be radiused. The unloading station 48 could be located at any position between the platen 22 and the loading station 33, or the operator could remove the finished tool at the loading station 33 before placing a wrench to be finished between the jaws 35 and 36. The actuating means for moving the jaws 35 and 36 between their release and engage positions could be provided by air or hydraulic operated mechanisms or by mechanical mechanisms other than the spring and cam mechanism illustrated. The radius of the wheel 28 can be large (e.g., 30 inches) to form an edge surface with a large radius on the edge of a wrench or bar being finished, or can be made smaller (e.g. 10 inches) to form an edge surface with a smaller radius on the edge of a wrench or bar being finished. The portion 72 of the frame means on which the wheel 28 is journaled could be movably mounted on rails disposed at a right angle to the axis 26 of the wheel 28 between the pivot plate 86 and the portion 72 rather than being vertically pivotable relative to the pivot plate 86 about the pivot pins 92. The belt grinding mechanism 16 illustrated could be replaced by a contact wheel about which the abrasive belt is moved so that the contact wheel would provide the backup platen, and the belt grinding assembly thus modified could be used for grinding surfaces other than edge surfaces on bars, such as to grind the gates or other projections off castings or other objects. Also, the positions of the jaws 35 and 36 relative to the slot shown in FIG. 2 may be reversed depending upon the direction in which the belt or wheel 28 is traveling.

Additionally, as stated above, the quick-change tool holder assembly of the present invention may be used in conjunction with any suitable machining means such as but not limited to milling machines, polishing machines, precision grinders, shapers, lathes, coated abrasive machines or bonded wheel machines.

The quick-change tool holder assembly of the present invention may also be used in conjunction with any suitable workpiece feed mechanisms such as but not limited to turrets, universal chucks, reciprocating feed systems, set-up wheels, feed through linear systems, horizontal rotary feed systems and robotic feed systems.

The present invention has now been described with reference to four embodiments thereof. It will be apparent to those skilled in the art that many changes can be made in the embodiment described without departing from the scope of the present invention. For example, the biasing means may comprise a spring to bias a slot member which includes bearing surfaces into engagement with the shoulder surfaces of the plate. Thus the scope of the present invention should not be limited to the structure described in this application, but only by structures described by the language of the claims and the equivalents of those structures.

We claim:

1. An easily changeable tool holder assembly adapted for use with a workpiece feed means and machining means for creating a new surface on a workpiece, said workpiece feed means having slot surfaces defining an opening extending axially through a peripheral portion of the workpiece feed means, said slot surfaces including bearing surfaces diverging on opposite sides of said opening, said tool holder assembly comprising a removable support including a plate adapted to be received in said slot, said plate having surfaces defining a socket opening through the bottom of said plate and having shoulder surfaces adapted to engage said bearing surfaces, said tool holder assembly including tool receptacle means projecting away from said removable support and having surfaces adapted to receive the workpiece, detent means including detent surfaces adapted to engage said surfaces defining said socket in said plate to position said plate at a predetermined location relative to said workpiece feed means, said detent means being mounted on the workpiece feed means for movement between a locking position with the detent surfaces of said detent means being engaged with the socket in said plate, and a release position with the detent surfaces of said detent means being disengaged with said socket and spaced therefrom to afford sliding movement of said support within said slot, biasing means adapted to bias said detent surfaces of said detent means toward said locking position and to bias said shoulder surfaces of said plate outward toward engagement with the bearing surfaces on the periphery of said workpiece feed means to provide secure frictional engagement between the shoulder surfaces of said plate and the bearing surfaces of said slot to thereby firmly hold said support on the periphery of said workpiece feed mechanism while said new surface is created on the workpiece by the machining means, and actuation means adapted for moving said detent means from said locking position to said release position against said bias of said biasing means and for overcoming the secure frictional engagement between the shoulder surfaces of said plate and the bearing surfaces of said slot provided by said biasing means before said plate is slid within said slot to thereby afford easy changing of said removable support and said tool receptacle means with a different removable support and tool receptacle means.

2. An easily changeable tool holder assembly according to claim 1 wherein said actuation means comprises an actuation arm.

3. An easily changeable tool holder assembly according to claim 2 wherein said actuation arm is L-shaped.

4. An easily changeably tool holder assembly according to claim 1 wherein said biasing means further include means for preventing said actuation means from accidentally moving said detent means from said locking to said release position.

5. An easily changeable tool holder assembly adapted for use with a workpiece feed means and machining means for producing a new surface on a workpiece, said workpiece feed means having slot surfaces defining an opening extending axially through a peripheral portion of the workpiece feed means, those slot surfaces including bearing surfaces diverging on opposite sides of said opening, said tool holder assembly comprising:

a removable support including a plate adapted to be received in said slot, said plate having shoulder surfaces adapted to engage said bearing surfaces, said tool holder assembly including tool receptacle means projecting away from said removable support and having surfaces adapted to receive the workpiece, means for positioning said plate at a predetermined location relative to said workpiece feed means, biasing means adapted to bias said shoulder surfaces of said plate into engagement with the slot bearing surfaces on the periphery of the workpiece feed means to provide secure frictional engagement between the shoulder surfaces of the plate and the bearing surfaces of said slot to thereby firmly hold the support on the periphery of the workpiece feed mechanism while the new surface is produced on the workpiece by the machining means, and actuation means adapted for overcoming the secure frictional engagement between the shoulder surfaces of the plate and the bearing surfaces of the slot before said plate is slid within said slot to thereby afford easy changing of said removable support and said tool receptacle means with a different removable support and tool receptacle means.

6. An easily changeable tool holder assembly according to claim 5 wherein said plate includes bottom surfaces defining a socket opening through the bottom of said plate, and said means for positioning said plate at a predetermined location comprises a rod having detent surfaces and shoulder surfaces adapted to engage a portion of the bottom surface of said plate to transmit the force of the biasing means from said rod to said plate.

7. An easily changeable tool holder assembly according to claim 6 wherein said means for positioning said plate at a predetermined location comprises detent means including detent surfaces adapted to engage said surfaces defining said socket in said plate to position said plate at a predetermined location relative to said workpiece feed means, said detent means being mounted on the workpiece feed means for movement between a locking position with the detent surfaces of said detent means being engaged with the socket in said plate, and a release position with the detent surfaces of said detent means being disengaged with said socket to afford sliding movement of said support within said slot.

8. An easily changeable tool holder assembly according to claim 6 wherein said biasing means is adapted to bias said detent surfaces of said detent means toward said locking position.

9. An easily changeable tool holder assembly according to claim 6 wherein said actuation means is adapted for moving said detent means from said locking position to said release position against said bias of said biasing means.

10. An easily changeable tool holder assembly according to claim 5 wherein said actuation means comprises an actuation arm.

11. An easily changeable tool holder assembly according to claim 10 wherein said actuation arm is L-shaped.

12. An easily changeable tool holder assembly adapted for use with a wheel assembly and belt grinding assembly for creating a new surface on a workpiece, which belt grinding assembly comprises frame means, a continuous abrasive belt having a backing with front and rear surfaces, and abrasive granules attached along said front surface, means for driving said abrasive belt in a first direction along a path relative to said frame means, said wheel assembly comprising a wheel having a periphery, means mounting said wheel on said frame means for rotation about an axis at a right angle to said first direction to sequentially move the periphery of said wheel past a loading station relative to said frame and then past said abrasive belt, said wheel having slot surfaces defining an opening extending axially through a peripheral portion of the wheel, said slot surfaces including bearing surfaces diverging on opposite sides of said opening, said tool holder assembly comprising:

a removable support including a plate adapted to be received in said slot, said plate having surfaces defining a socket opening through the bottom of said plate and having shoulder surfaces adapted to engage said bearing surfaces, said tool holder assembly including tool receptacle means projecting away from said removable support and having surfaces adapted to receive the workpiece, detent means including detent surfaces adapted to engage said surfaces defining said socket in said plate to position said plate at a predetermined location relative to said wheel, said detent means being mounted on the wheel for movement between a locking position with the detent surfaces of said detent means being engaged with the socket in said plate, and a release position with the detent surfaces of said detent means being disengaged with said socket and spaced therefrom to afford sliding movement of said support within said slot, biasing means adapted to bias said detent surfaces of said detent means toward said locking position and to bias said shoulder surfaces of said plate outward toward engagement with the bearing surfaces on the periphery of said wheel to provide secure frictional engagement between the shoulder surfaces of said plate and the bearing surfaces of said slot to thereby firmly hold said support on the periphery of said wheel while said new surface is created on the workpiece by the belt grinding assembly, and actuation means adapted for moving said detent means from said locking position to said release position against said bias of said biasing means and for overcoming the secure frictional engagement between the shoulder surfaces of said plate and the bearing surfaces of said slot before said plate is slid within said slot to thereby afford easy changing of said removable support and said tool receptacle means with a different removable support and tool receptacle means.

13. An easily changeable tool holder assembly adapted for use with a wheel assembly and belt grinding assembly for creating a new surface on a workpiece, which belt grinding assembly comprises frame means, a continuous abrasive belt having a backing with front and rear surfaces, and abrasive granules attached along said front surface, means for driving said abrasive belt in a first direction along a path relative to said frame means, said wheel assembly comprising a wheel having a periphery, means mounting said wheel on said frame means for rotation about an axis at a right angle to said first direction to sequentially move the periphery of said wheel past a loading station relative to said frame and then past said abrasive belt, said wheel having slot surfaces defining an opening extending axially through a peripheral portion of the wheel, said slot surfaces including bearing surfaces diverging on opposite sides of said opening, said tool holder assembly comprising:

a removable support including a plate adapted to be received in said slot, said plate having shoulder surfaces adapted to engage said bearing surfaces, said tool holder assembly including tool receptacle means projecting away from said removable support and having surfaces adapted to receive the workpiece, means for positioning said plate at a predetermined location relative to said wheel, biasing means adapted to bias said shoulder surfaces of said plate toward engagement with the bearing surfaces on the periphery of said wheel to provide secure frictional engagement between the shoulder surfaces of said plate and the bearing surfaces of said slot to thereby firmly hold said support on the periphery of said wheel while said new surface is produced on the workpiece by the belt grinding assembly, and actuation means adapted for overcoming the secure frictional engagement between the shoulder surfaces of said plate and the bearing surfaces of said slot before said plate is slid within said slot to thereby afford easy changing of said removable support and said tool receptacle means with a different removable support and tool receptacle means.

14. An easily changeable tool holder assembly according to claim 13 wherein said actuation means comprises an actuation arm.

15. An easily changeable tool holder assembly according to claim 14 wherein said actuation arm is L-shaped.

* * * * *

UNITED STATES PATENT AND TRADEMARK OFFICE

CERTIFICATE OF CORRECTION

PATENT NO. : 5,165,204

DATED : November 24, 1992

INVENTOR(S) : Arthur P. Luedeke et al

It is certified that error appears in the above-indentified patent and that said Letters Patent is hereby corrected as shown below:

Col. 1, line 37, after "belt" insert --.--.

Col. 2, line 21, after "workpiece" insert --.--.

Col. 3, line 22, after "buttons" insert --7--.

Col. 3, line 22, before "Such" delete --7--.

Col. 9, line 28, delete "20".

Col. 9, line 46, after "out" insert --of slot 94A--.

Col. 10, line 13, after "opening" insert --.--.

Col. 12, line 28, after "assembly" insert --.--

Col. 15, line 48, after "comprising" insert --:--.

Signed and Sealed this

Thirty-first Day of May, 1994

Bruce Lehman

*Attest:*

BRUCE LEHMAN

*Attesting Officer*

*Commissioner of Patents and Trademarks*